US007264134B2

(12) United States Patent
Tulp

(10) Patent No.: US 7,264,134 B2
(45) Date of Patent: Sep. 4, 2007

(54) COMBINATION COASTER AND SLEEVE APPARATUS

(76) Inventor: David W. Tulp, 144 Terrace Trail West, Lake Quivira, KS (US) 66217

( * ) Notice: Subject to any disclaimer, the term of this patent is extended or adjusted under 35 U.S.C. 154(b) by 515 days.

(21) Appl. No.: 10/924,671

(22) Filed: Aug. 24, 2004

(65) Prior Publication Data

US 2006/0043097 A1 Mar. 2, 2006

(51) Int. Cl.
*B65D 25/20* (2006.01)

(52) U.S. Cl. ..... 220/739; 220/903

(58) Field of Classification Search ..... None
See application file for complete search history.

(56) References Cited

U.S. PATENT DOCUMENTS

| | | | | |
|---|---|---|---|---|
| 4,194,627 | A * | 3/1980 | Christensen | 206/545 |
| D261,592 | S | 11/1981 | Wilson | |
| 5,205,473 | A | 4/1993 | Coffin, Sr. | |
| 5,425,497 | A | 6/1995 | Sorensen | |
| 5,826,788 | A | 10/1998 | Redding | |
| D411,079 | S | 6/1999 | Graham | |
| 6,026,983 | A | 2/2000 | Graham | |
| 6,164,487 | A | 12/2000 | Hicks | |
| 6,273,333 | B1 | 8/2001 | Ward | |
| 6,290,091 | B1 | 9/2001 | Bell | |
| 6,343,735 | B1 | 2/2002 | Cai | |
| 6,412,609 | B2 | 7/2002 | Asai | |
| D480,609 | S | 10/2003 | Hicks et al. | |
| 2004/0011801 | A1 | 1/2004 | Rodriguez | |

OTHER PUBLICATIONS

F-D-S Manufacturing Co, Inc. website at www.fdsmfg.com, Accessed on Feb. 18, 2004.

Fibre Box Handbook, Fibre Box Association, 2850 Golf Road, Rolling Meadows, Il 60008, copyright 1992, p. 8, 9, 12, 16, 28, 29.

Product literature of Sonoco found at website www.sonoco.com/topnav/products+and+services/consumer+packaging/coaster+and+g...,Accessed on Feb. 24, 2004.

* cited by examiner

*Primary Examiner*—Stephen J. Castellano
(74) *Attorney, Agent, or Firm*—Mark E. Brown

(57) ABSTRACT

An improved combination holder and coaster apparatus for receiving a container or vessel which includes first and second thermally insulative, flexible panels joined together by a joint comprised of a stretchable, flexible, adhesive material adapted to return the device to a collapsed coaster configuration. While in receipt of the vessel or container, the device is adapted to an elliptical holder configuration in which the panels are separated by a projected dihedral angle generally between approximately 0 degrees through approximately 180 degrees allowing the elliptical holder to receive the vessel or container.

22 Claims, 7 Drawing Sheets

COMBINATION COASTER AND SLEEVE APPARATUS

BACKGROUND OF THE INVENTION

1. Field of the Invention

The present invention relates generally to an improved combination holder and coaster apparatus, and in particular to such an apparatus for a beverage container or vessel such as a can, cup, glass or bottle, which contains and dispenses liquid.

2. Discussion of the Related Art

Beverage holders are available in many different configurations for gripping and insulating beverage containers and vessels. Common insulating beverage holders are constructed of polystyrene, closed or open cell foam, vinyl, plastic or neoprene and are shaped into cylindrical forms into which beverage containers and vessels such as cups, cans, glasses or bottles can be inserted. These devices tend to be bulky and do not store easily because they generally retain their cylindrical shape after use.

Further beverage holder insulating devices are constructed from a fiberboard material which can be less expensive than plastic material. A common design of such insulating devices is accomplished by folding the material on top of itself resulting in an overlap of the fiberboard material to help support and secure such devices. This overlap also limits the usefulness of such devices because of the static nature of the connection. Also, by overlapping the material, there is an unnecessary increased cost associated with the excess material. In addition, an overlap of material can cause the compressed container to inadequately function as a coaster due to excessive material at a fold. Moreover, because there are many different sized containers and vessels in use today, most current fiberboard beverage holders have limited practical usefulness.

Another disadvantage associated with the use of current beverage vessels or containers is that when the container is colder than the ambient air, the temperature differential causes condensation to form on the outside of the beverage container, allowing liquid to accumulate on the container. These beverage containers then cause liquid to spill on the horizontal resting surface causing water damage to such surface or on the users of such containers. In addition, the container can become slippery and difficult to hold.

It would be advantageous for a beverage holder to serve a dual role as a holder device and a coaster device, expanding to receive a number of different sized containers or vessels, absorbing any accumulating condensation, providing a non-slick gripping surface, maintaining the temperature of the liquid and protecting the hand from discomfort. In addition, it would be beneficial to store multiple beverage coaster and holder devices in a compact wall mountable dispenser.

The Graham U.S. Pat. No. 6,026,983 discloses a combination beverage sleeve and coaster device which uses a significant amount of excess material to create and support the device. The Coffin U.S. Pat. No. 5,205,473 discloses a recyclable insulating beverage container with recyclable adhesive. The Rodriquez U.S. Patent Application Publication Number 20040011801 discloses a combination adjustable diameter beverage holder and recyclable coaster.

Heretofore there has not been available a combination holder and coaster apparatus with the advantages and features of the present invention.

BRIEF DESCRIPTION OF THE INVENTION

In the practice of one aspect of the present invention, an improved combination holder and coaster apparatus is provided for absorbing liquid condensation and providing thermal insulation for a beverage container or vessel. The apparatus is adapted for receiving various types and sizes of beverage vessels and containers, including cups, cans, glasses and bottles. The apparatus includes a pair of panels of thermally insulative material which is secured with a flexible joint to form an opening to receive the beverage container. The lining of the fibrous material is designed to absorb condensation while providing channels of air to help insulate the beverage container from the ambient environment and the user of the beverage container from the temperature of the liquid within the beverage container. The outer shell of the device is further adapted for receiving a graphical image or logo.

BRIEF DESCRIPTION OF THE DRAWINGS

The drawings constitute a part of this specification and include exemplary embodiments of the present invention and illustrate various objects and features thereof.

DETAILED DESCRIPTION OF THE INVENTION

I. Introduction and Environment

As required, detailed embodiments and/or aspects of the present invention are disclosed herein; however, it is to be understood that the disclosed embodiments/aspects are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, opposite, interior, outer, inner and juxtaposed refer to certain aspects of the invention in reference to one another. The words, "fibrous," "ellipse," "smooth," "corrugated," "elastic," "flexible," "thermally-insulative," "stretchable," are general characteristics and should not be considered as limits on the invention.

II. Preferred Embodiment Combination Coaster and Elliptical Holder 2

Without limitation on the generality of useful applications of the invention in its different aspects and embodiments, the device is adapted for displaying a graphical image, providing thermal insulation, absorbing condensation, lying flat on a horizontal surface and receiving a container or vessel.

Figures 1, 2, 3:
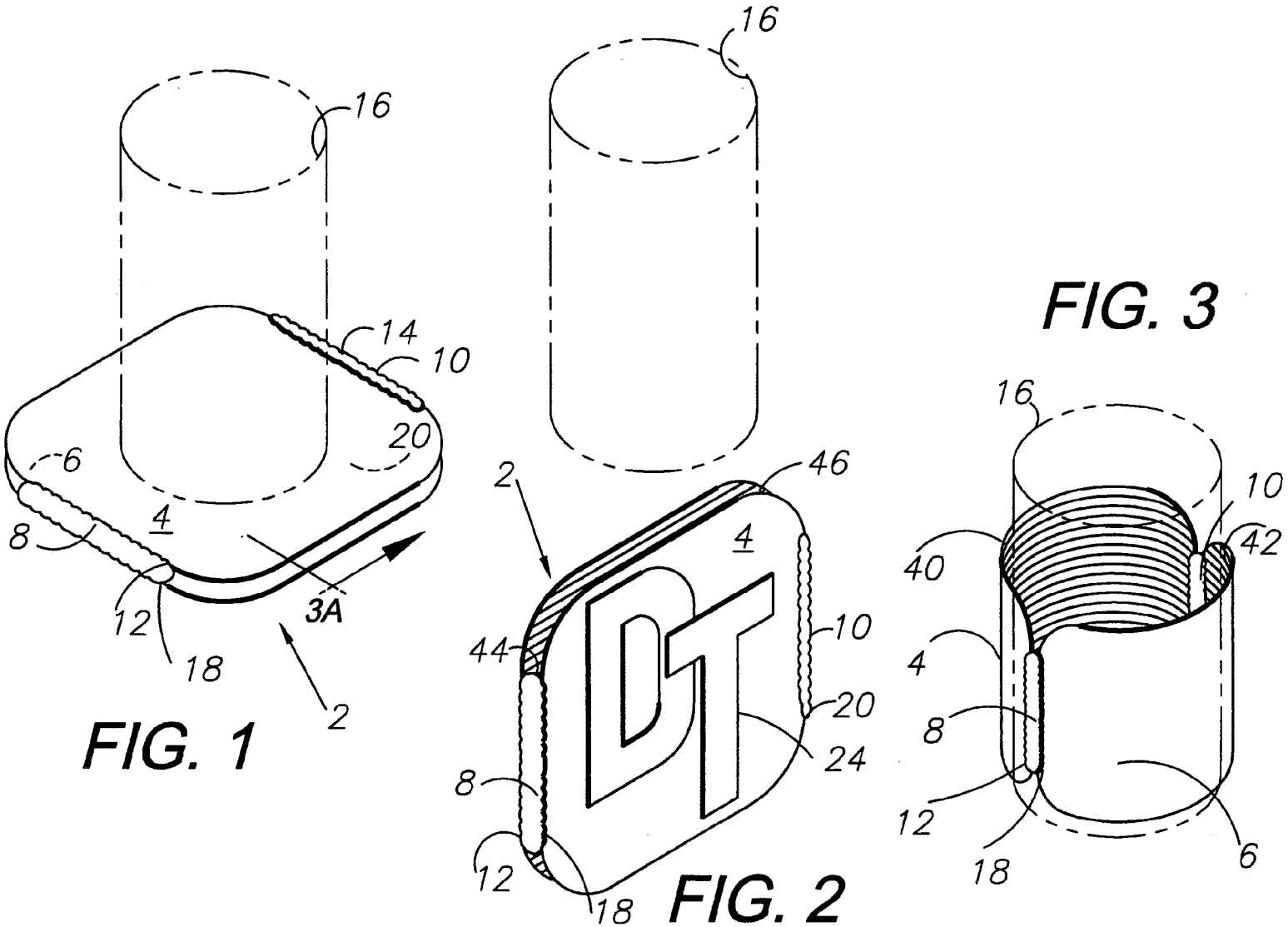
FIG. 1 is an upper perspective view of a combination holder and coaster apparatus in a collapsed coaster configuration comprising an aspect of the present invention.
FIG. 2 is an upper perspective view of the combination holder and coaster apparatus in a vertical position.
FIG. 3 is an upper perspective view of the combination holder and coaster apparatus in an elliptical holder configuration.

Referring to the drawings, FIG. 1 shows the combination coaster and elliptical holder device 2 in its collapsed coaster configuration supporting a vessel or container 16 on the device's 2 horizontal surface. The device 2 includes a first insulative panel 4 and a second insulative panel 6 connected to the first insulative panel 4 by first 8 and second 10 connection joints wherein said panels 4, 6 each include a pair of attachment points 12, 14 and 18, 20 respectively. Each pair of attachment points is located on opposite sides of an insulative panel such that the first attachment point 12 is located on an edge of the first insulative panel 4, and the second attachment point 14 is located on an opposite edge of the same insulative panel 4. In the device's coaster configuration (FIG. 1), the first and the second insulated panels 4, 6 are positioned horizontally over one another with the vessel or container 16 resting on the smooth outer face 30 of one of the insulative panels 4. Although the insulative panels may be constructed with a variety of insulative materials including cellulous, fibrous or other insulative materials, the invention is preferably constructed from a cellulous material.

In its coaster configuration, the first and second connection joints 8, 10 enable the coaster device 2 to lie flat along a horizontal surface supporting the vessel or container 16 in an upright position, to prevent any condensation from rolling off the coaster onto an underlying horizontal surface and to allow the display of a graphical image affixed to the device's outer face 30. The coaster configuration is also designed to allow the device 2 to have a uniform thickness which is generally the sum of the first panel thickness and the second panel thickness.

FIG. 2 shows the device 2 in a vertically upright position with a first and second dihedral angle 44, 46 formed between the first and second insulative panels. In this position, the device 2 opens up to receive the vessel or container 16 enabling the elliptical cross-sectional holder configuration depicted in FIG. 3.

In FIG. 3 the elliptical holder configuration is shown in which the first and second flexible insulative panels 4, 6 separate to receive the vessel or container 16. In this configuration the first and second insulative panels 4, 6 form dihedral angle 44, 46 at the first and second connection joints 8, 10. The dihedral angles 44, 46 are adjustable through a range of approximately 0° to approximately 180° as the first and second insulative panels 4, 6 separate to receive the vessel or container 16. As the panels separate and the dihedral angles increases the device's cross section is generally elliptically shaped. As the dihedral angles approach generally 180° the cross section becomes more circular in shape.

The inner face 40, 42 of each insulative panel 4, 6 surrounds the vessel or container 16 creating a thermal barrier between the vessel 16 and the ambient environment, helping vessel users avoid any unnecessary discomfort during such use. In the elliptical holder configuration, a graphical images 24 is optionally displayed on the outer face 30 of the first insulative panel 4.

Figure 3A:
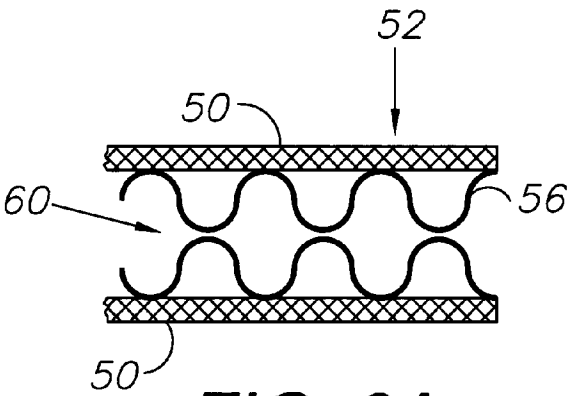
FIG. 3A is a sectional view of an insulative panel taken generally along line 3A in FIG. 1.

In FIG. 3A, an embodiment of the insulative panel is shown with a smooth outer face 52 and an open inner face 50 with an optional corrugation 56. The corrugation 56 may include an optional coating to prolong the useful life of the device 2 such as a moisture resistance coating or a coating to provide additional support such as corn or wheat starch. In FIG. 3A the single faced corrugated material has flutes 60 and an inner face 50 which are thermally-insulative and are comprised of a flexible fibrous material. The flutes 60 enhance the insulation of the device by having a larger surface area in close proximity to the vessel or container, insulating the vessel from the ambient environment. FIG. 3A also shows a shock-absorbing configuration of the corrugated surfaces whereby the flutes can absorb a downward force exerted by a container or vessel.

In the typical configuration of the device 2, the thermally insulative panels 4, 6 insulate the vessel 16 by forming a thermal barrier between the smooth outer face 52 and the inner face 50 which is adjacent to the surface of the vessel or container. In this manner, the ambient environment is separated from the surface of the vessel 16 with the smooth outer face 52 bordering the outside edge of the inner face 50. In another embodiment, the inner face 50 is comprised of an absorbent material to help absorb any accumulated condensation on the outside of the vessel or container.

Figure 4:
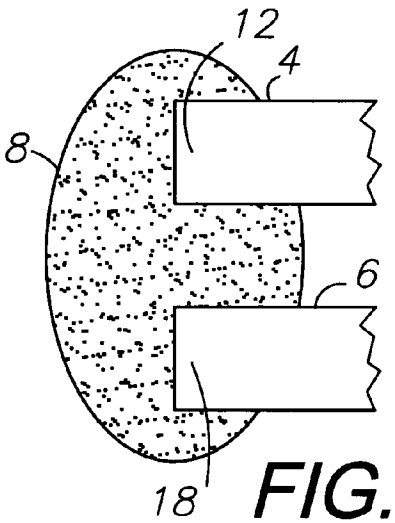
FIG. 4 is a fragmentary, profile view of a connection joint connecting a first insulative panel to a second insulative panel in a collapsed coaster configuration.

FIG. 4 illustrates the connection joint 8 attached to the first insulative panel 4 at an attachment point 12 and the connection joint 8 also attached to the second insulative panel 6 at another attachment point 18. Although there are other possible configurations, the connection joint 8 as depicted in FIG. 4 has a surface area greater than the sum of the first and second insulative panels 4, 6 at the attachment locations 12, 18. Although different methods of joining the insulative panels 4, 6 would include mechanical fasteners, material fasteners, and adhesives, in the illustrated embodiment the connection joint is a flexible adhesive joint.

Alternative joint arrangements could include sandwiching the joint between the first and second insulative panels 4, 6 or shifting the joint along the horizontal plane parallel to the insulative panels 4, 6 with less or more overlap between the joint 8 and the panels 4, 6. However, the attachment locations 12, 18 by their nature are determined by the overlapping of the insulative panels 4, 6 with the connection joint 8. Therefore, the position and nature of the attachment locations 12, 18 will vary with the location and dimension of the overlap of the connection joint 8 and the insulative panels 4, 6. In the preferred configuration, the attachment locations 12, 18 will have at least one point in common with the connection joint 8 but not necessarily in common with each other.

Figure 6:
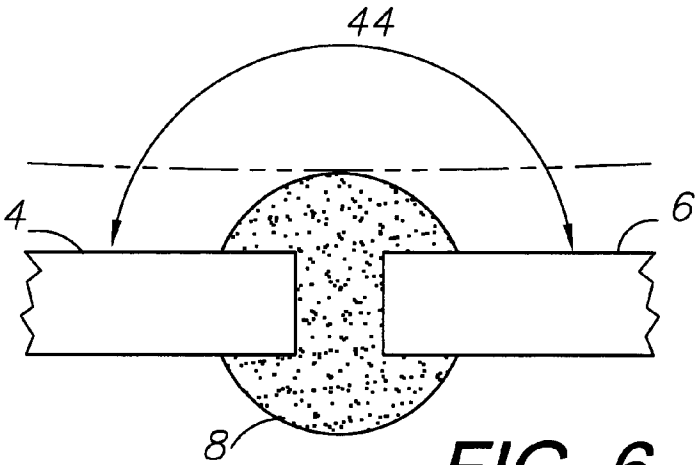
FIG. 6 is a fragmentary, profile view of the connection joint connecting the first and second insulative panels in an elliptical holder configuration.
Figure 5:
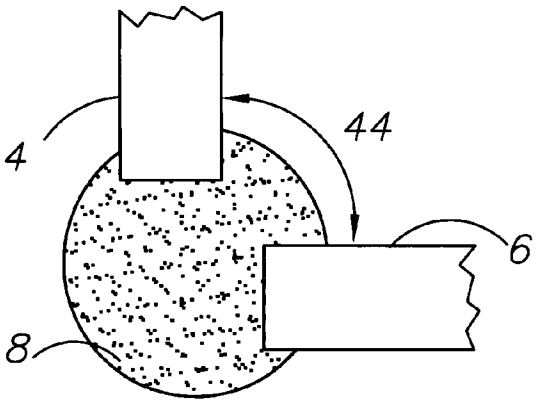
FIG. 5 is a fragmentary, profile view of the connection joint connecting the first and second insulative panels in an elliptical holder configuration.

FIG. 5 illustrates a dihedral angle 44 formed between the first and second insulative panels 4, 6 as the panels are projected onto one another at the connection joint 8. In FIG. 5, the first insulative panel 4 when projected onto the second insulative panel 6 forms a dihedral angle 44 of generally approximately 90°. In the preferred embodiment, the dihedral angle is adjustable through a range of generally approximately 0° through generally approximately 180° as depicted in FIG. 6.

Figure 7:
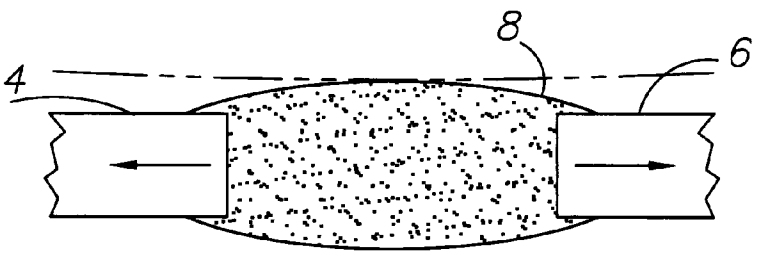
FIG. 7 is a fragmentary, profile view of a connection joint connecting the first and second insulative panels in an enlarged receiver configuration.

A third configuration of the device 2 is shown in FIG. 7, in which the connection joint 8 stretches along the horizontal plane to provide for an enlarged receiver configuration. In this configuration, the connection joint 8 allows the first insulated panel 4 to expand away from the second insulating panel 6 to receive a container or vessel 16 whose circumference is greater than the sum of the lateral distances of both insulated panels 4, 6. This enlarged receiver configuration allows the holder to expand to receive a variety of sizes of vessels or containers.

II. Modified Embodiment Combination Coaster and Elliptical Holder 2

Figure 9:
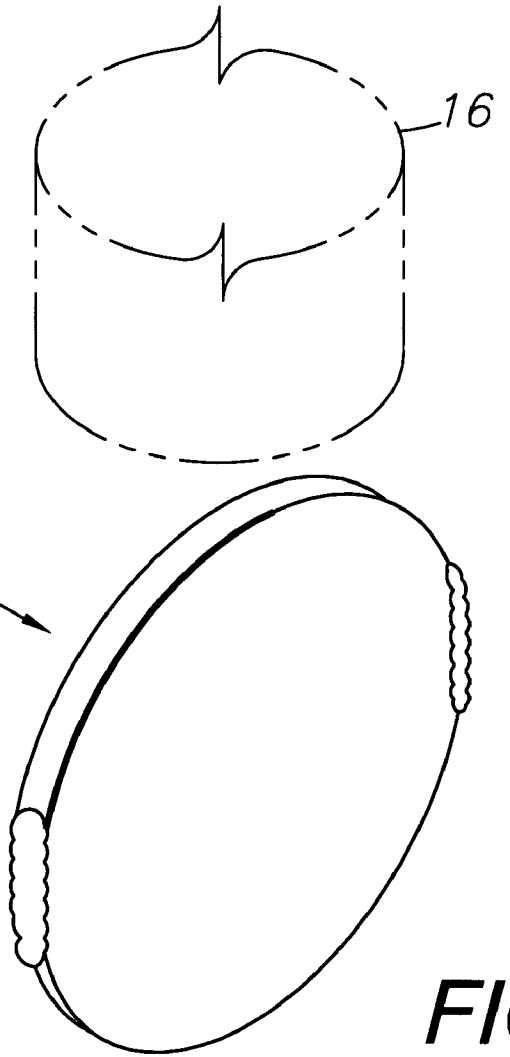
FIG. 9 is an upper, perspective view of the apparatus in a vertical upright position.
Figure 8:
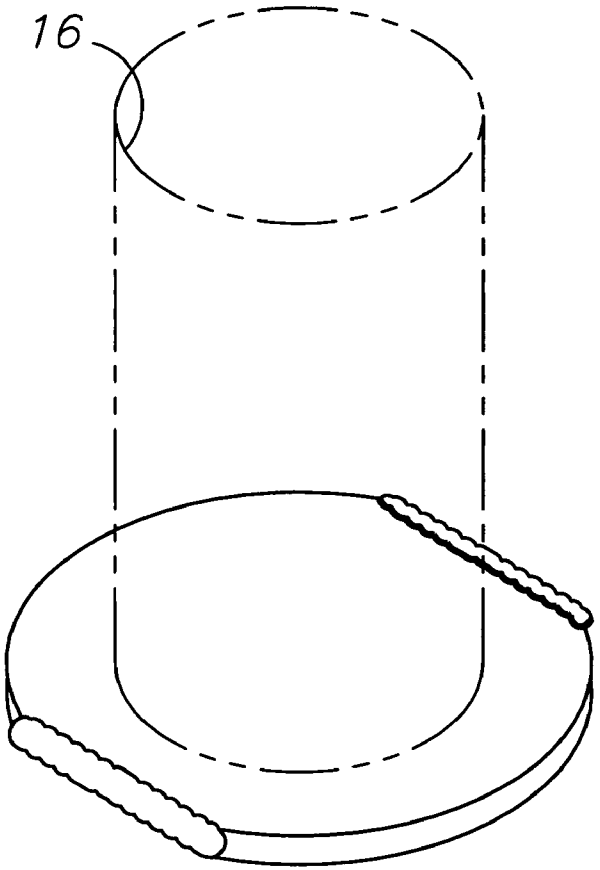
FIG. 8 is an upper, perspective view of an apparatus in a collapsed coaster configuration comprising an alternative embodiment of the present invention.

FIGS. 8 and 9 show an alternative embodiment of the device 102 in which the insulated panels are generally circular shaped, forming a device with a circular shaped, collapsed coaster configuration and a circular shaped elliptical cross-sectional holder configuration.

Figure 10:
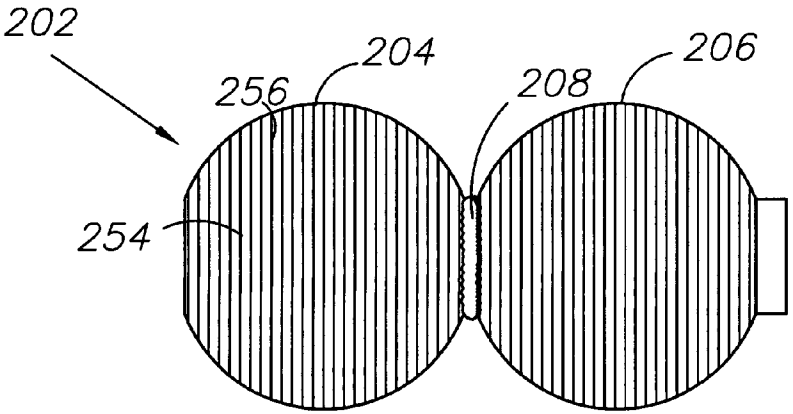
FIG. 10 is a plan view of a blank for forming the apparatus, shown in an open position with an adhesive joint connecting the first to the second insulative panels.

The inner corrugated lining 254 of the insulative panels 204, 206 can be seen in FIG. 10. In addition, FIG. 10 shows another embodiment of the device 202 in which a first connection joint 208 is parallel to the corrugated flutes 256 of the device.

Figure 11:
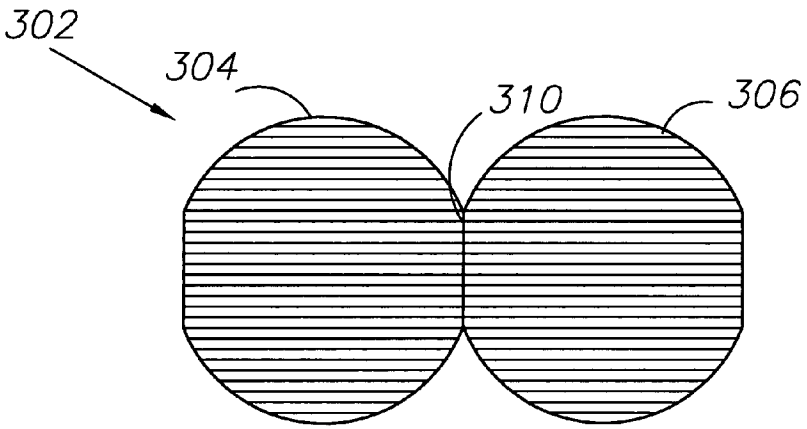
FIG. 11 is a plan view of another blank for forming the apparatus, shown in an open position with a fold line connecting the first to the second insulative panels.

In another alternative embodiment for joining the insulative panels, FIG. 11, shows the device 302 in an open-faced arrangement in which the first insulative panel 304 is connected to the second insulative panel 306 along a joint of interconnected fibrous material 310. In this embodiment, the first connection joint, which is not depicted, will be an adhesive flexible material and the second connection joint will be a fibrous interconnected material 310 such as a fold line.

Figure 14:
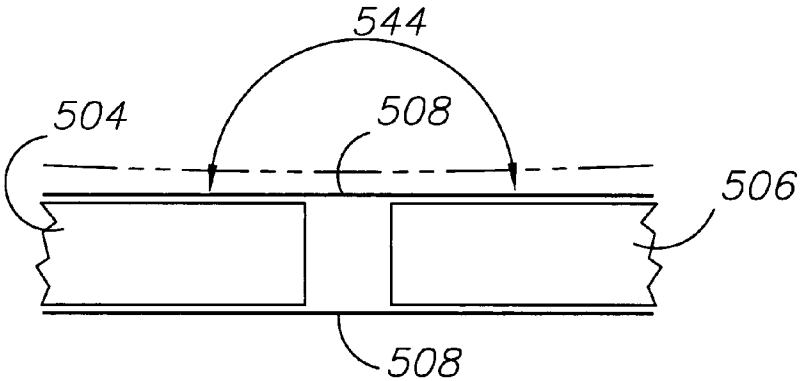
FIG. 14 is a fragmentary, cross-sectional view of the first and second insulative panels connected to each other.
Figure 15:
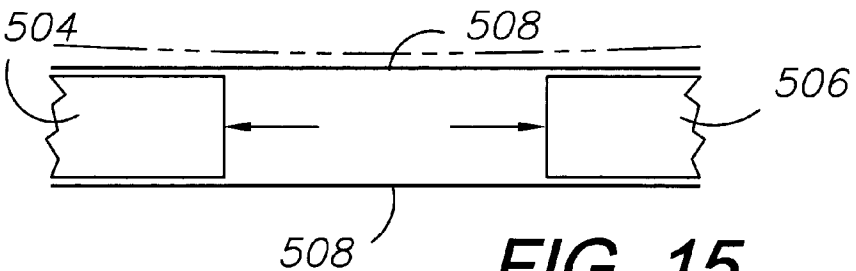
FIG. 15 is a fragmentary, cross-sectional view of the first and second insulative panels connected to and adjacent to each other.
Figure 12:
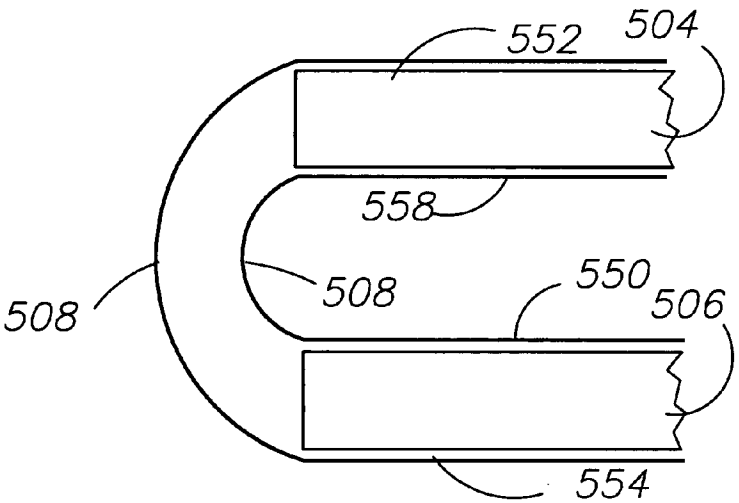
FIG. 12 is a fragmentary cross-sectional view of the first insulative panel connected to and positioned above the second insulative panel.
Figure 13:
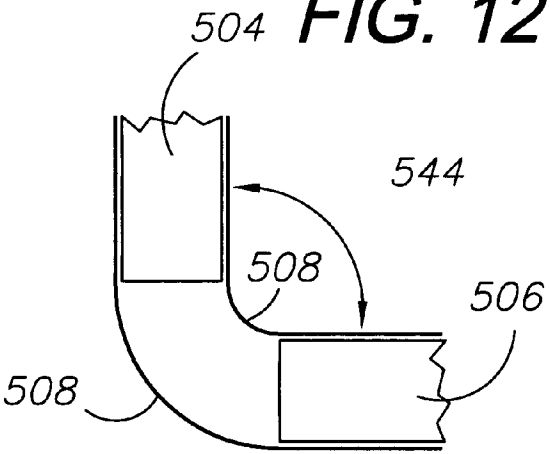
FIG. 13 is a fragmentary cross-sectional view of the first and second insulative panels connected to and perpendicular to each other.

FIGS. 12-15 show an alternative connection joint comprised of a flexible, stretchable, elastic adhesive material such as tape, joining the first and second insulative panels 504, 506. As shown in FIG. 12, the smooth outer faces 552, 554 and the inner faces 550, 558 of first and second insulative panels 504, 506 are connected using, one or both, tape joints 508. In FIG. 13, the joined insulative panels 504, 506 are shown separated by an approximately 90° dihedral angle 544 at the joint 508. In FIG. 14, the joined insulative panels 504, 506 are shown separated along a dihedral angle 544 of approximately 180° at the adhesive material connection joint 508. In FIG. 15, the joined insulative panels 504, 506 are stretched along a horizontal plane in an enlarged receiver configuration at an adhesive material connection joint 508 in order to accommodate a larger vessel or container. In FIGS. 12-15, the insulative panels 504, 506 are secured using the adhesive material on the smooth outer faces 552, 554 and the inner faces 550, 558. Alternatively, the insulative panels could be joined on the smooth outer faces 552, 554 only, the inner faces 550, 558 only or on both the smooth outer faces 552, 554 and the inner faces 550, 558 as illustrated.

Figure 16:
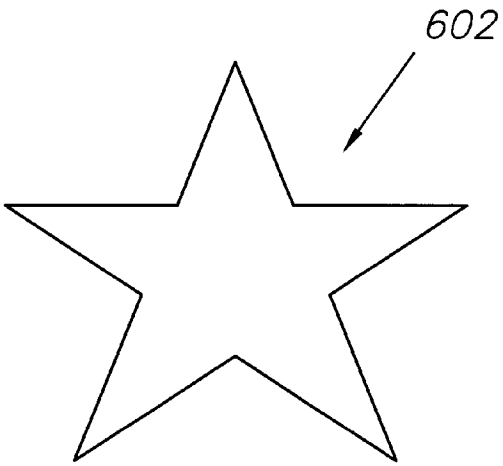
FIG. 16 is an elevational view of the apparatus in an alternative, collapsed coaster configuration.

Because of the flexibility and adaptability of the device which uses two attachment points per side, the device 602 can have a wide variety of shaped insulative panels, such as the star shape shown in FIG. 16. By utilizing a connection joint formed at a pair of attachment points, the insulative panels can utilize unusual shapes and dimensions in the construction of the device 602.

Figure 17:
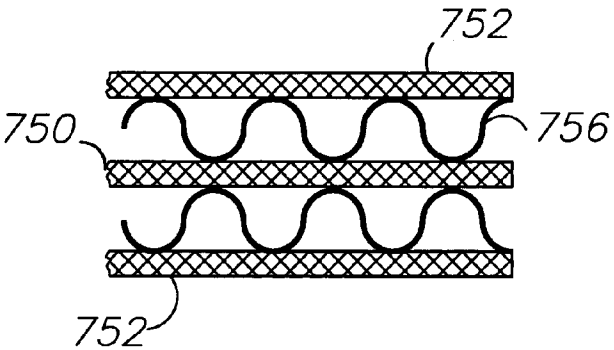
FIG. 17 is a sectional view of an alternative embodiment of the insulative panel taken generally along line 3A in FIG. 1.

In FIG. 17, an alternative double-faced embodiment of the insulative panel is shown. Each panel includes a smooth outer face 752 and a shared inner face 750 and optional corrugation 756 between. Alternatively, the shared inner face 750 could include multiple inner faces. In FIG. 17 the corrugated material 756 is sandwiched between the flexible fibrous material faces 750,752.

Figure 18:
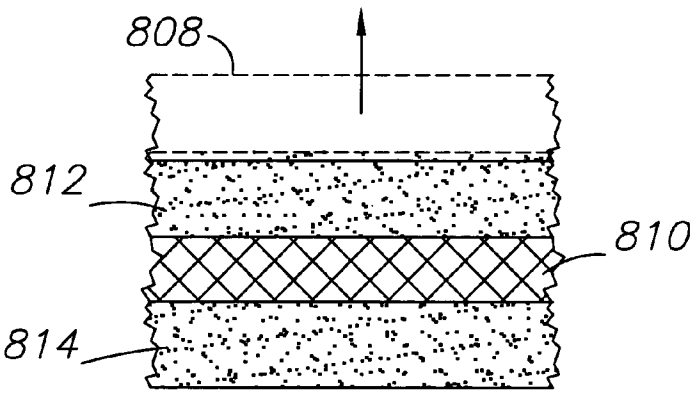
FIG. 18 is a typical composition of an insulative panel.

FIG. 18 shows an embodiment with a tape-joint 808 in with a stretchable portion of the tape 810 sandwiched between a top 812 and bottom 814 region which are each less-flexible. The less-flexible regions 812, 814 are each adhesive.

Figure 19:
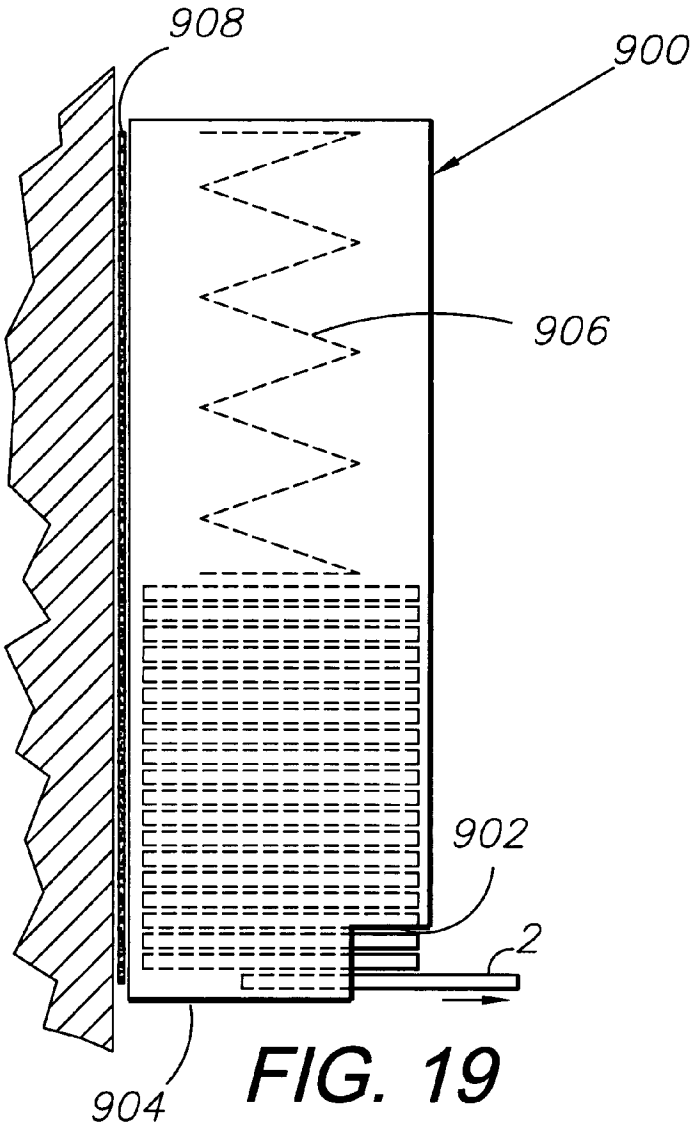
FIG. 19 is sectional view of another embodiment of the invention.

FIG. 19 shows another feature of the present invention in which the invention is packaged and dispensed in a portable carton 900 in which multiple devices 2, positioned in the collapsed coaster configuration, are stored and then dispensed through an opening 902 at the bottom 904 of the carton 900. As a coaster device 2 is removed another coaster falls into position to be removed at the next instance. Optionally, the coasters can be mechanically positioned by placing a positioning mechanism 906, e.g. a spring, within the carton to position the coaster in the bottom of the carton, enabling a consistent dispensing of the devices 2. In the embodiment shown the carton attaches to a wall using a fastener 908. Although the fastener can be screws, rivets or other types of mechanical fasteners, the preferred method is a double sided adhesive fastener.

Figure 20:
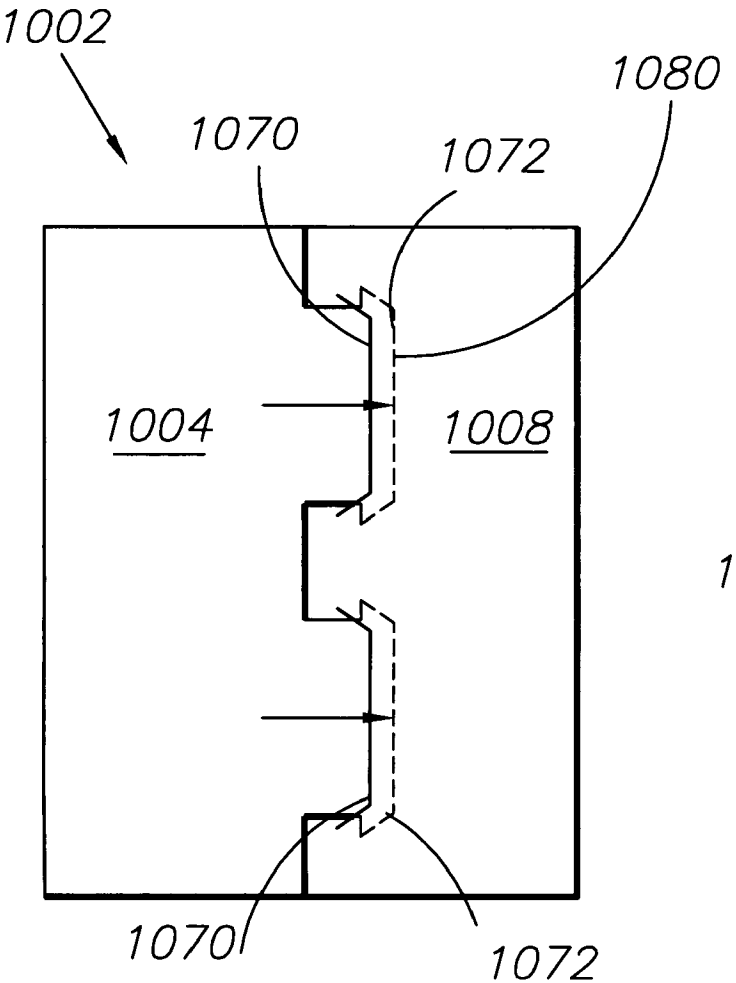
FIG. 20 is a plan view of another embodiment of the invention.

FIG. 20 shows another embodiment of the present invention in which one joint of the coaster device 1002 is comprised of a mechanically fastened joint 1008 and a panel 1004 is configured to receive a guide 1070 which interlocks the panel when fastened. In the embodiment shown, two guides 1070 are inserted into two slots 1072. Once the guides are inserted into the slots, the combination forms an interlocking mechanism 1080 that secures the panel 1004.

Figure 21:
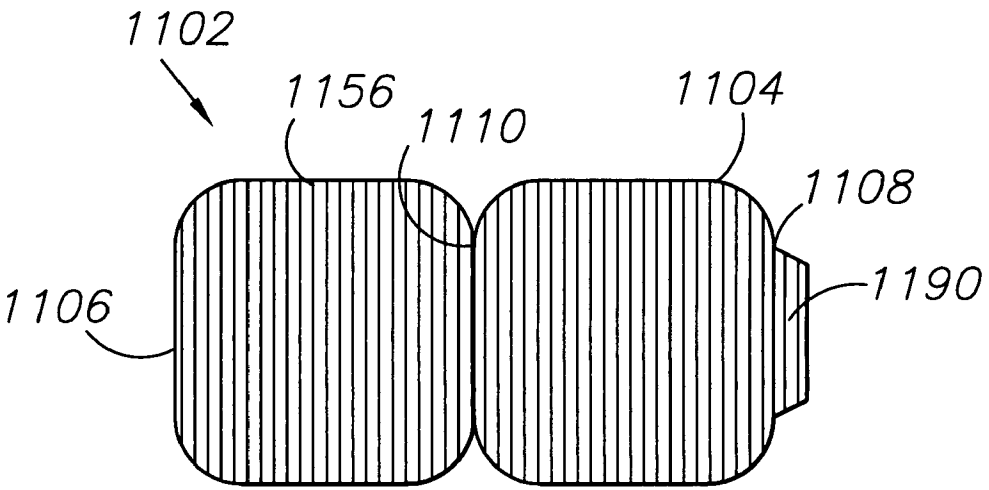
FIG. 21 is a plan view of another embodiment of the invention.

FIG. 21 shows an alternative embodiment of the system 1102 in which the insulative panels 1104, 1106 are generally rectangularly shaped with a first connection joint 1108 and a second connection joint 1110. The first connection joint 1108 is folded and adhesively joins a tab panel 1190 to the second insulative panel 1106 using a adhesive material bonded between the panels, and the second connection joint 1110 being a seam which is a foldable fiberous interconnecting material, said connection joints 1108 and 1110 being parallel to the corrugated flutes 1156 of the device 1102. The tab panel 1190 is optionally corrugated.

It will be appreciated that the components of the device 2 can be used for various other applications. Moreover, the device 2 can be fabricated in various sizes and from a wide range of suitable materials, using various manufacturing and fabrication techniques.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A combination holder and coaster device for a beverage container or vessel, which device comprises:

a first insulative panel having an outer face, an inner face, opposite sides and a pair of attachment points, each located at a respective side;

a second insulative panel having an outer face, an inner face, opposite sides and a pair of attachment points each located at a respective side and each being located adjacent to a respective first panel attachment point;

each said panel comprising a flexible, thermally-insulative material;

first and second connection joints each connecting the first insulative panel to the second insulative panel at respective, adjacent attachment points;

said first connection joint comprising a stretchable, flexible adhesive material bonded to said first and second panels at the respective panel attachment points;

said device having a collapsed coaster configuration with said first and second panels positioned in juxtaposed, overlying relation and an overall thickness which is generally the sum of the thicknesses of said first and second panels;

said device having a generally elliptical cross-sectional holder configuration defining a receiver adapted to receive a beverage container or vessel therebetween;

said device having a memory characteristic which enables the device to spring back to the collapsed coaster configuration when empty; and said panels presenting first and second adjustable projected dihedral angles at said first and second joints respectively.

2. The device according to claim 1 wherein said thermally-insulative material is a fibrous material.

3. The device according to claim 1 wherein said first connection joint is a stretchable, flexible adhesive material bonded to said first and second panels at the respective panel attachment points.

4. The device according to claim 1 wherein said thermally-insulative panel is further comprised of a single-faced corrugated medium.

5. The device according to claim 1 wherein said thermally-insulative panel is further comprised of a double-faced corrugated medium.

6. The device according to claim 1 wherein said first connection joint is located between said first attachment point on said first insulative panel and said first attachment point on said second insulative panel and said second connection joint is located between said second attachment point on said first insulative panel and said second attachment point on said second insulative panel.

7. The device according to claim 6 wherein said first and second insulating panels are formed by a single sheet of corrugated material, enabling said first insulating panel to be joined to said second insulating panel at a second connection joint comprised of a fold line.

8. The device according to claim 6 wherein said second connection joint is comprised of a stretchable, flexible adhesive material bonded to said first and second panels at the panel attachment points and having a memory characteristic.

9. The device according to claim 6 wherein device is said collapsed coaster configuration has a generally flat, uniform, vertical thickness.

10. The device according to claim 1 wherein said first and second insulative panels have general configurations from among the group consisting of rectangular, circular and irregular.

11. The device according to claim 1 wherein said inner face is further comprised of an absorbent, porous, fiber material and the smooth outer face is further comprised of a non-slick frictional surface.

12. The device according to claim 4 wherein the corrugated inner faces of the first and second insulative panels are further comprised of multiple flutes arranged to absorb a downward force by positioning the fluted portions of the corrugated material on the first insulative panel adjacent to the fluted portions of the corrugated material on the second insulative panel with the device in its coaster configuration.

13. The device according to claim 1 wherein said first and second connection joints are seams joining said insulating panels along opposite sides and extending along the edges of said sides.

14. The device according to claim 1 wherein said first connection joint is a strip of stretchable, flexible, adhesive tape-like material.

15. The device according to claim 1 wherein said second connection joint is a guide-slot interlocking combination joint.

16. The device according to claim 1 wherein said memory characteristic is biased to the collapsed coaster configuration when the vessel or container is removed.

17. The device according to claim 1 wherein said first connection joint enables the device to frictionally receive different sized vessels and containers by flexibly stretching at the connection joint.

18. The device according to claim 1 wherein said first and second dihedral angles synchronically adjust.

19. The device according to claim 1 wherein said panel outer surfaces are generally smooth and each includes a graphical image.

20. The device according to claim 1 wherein said device has a generally enlarged receiver configuration with a first connection joint including an elastic material defining a receiver adapted to receive an enlarged beverage container or vessel therebetween.

21. The device according to claim 1 wherein said flexible, stretchable adhesive material is a flexible tape such that the middle region of the tape is elastically stretchable surrounded by a less stretchable bottom and top region which are adhesively attached to said first and second panel.

22. A combination holder and coaster device for a beverage container or vessel, comprising:

a first insulative panel having opposite sides, an interior portion, a smooth outer face adapted to receive a graphical image, a single-faced corrugated inner face and a first and second attachment points each located at a respective side;

a second insulative panel having opposite sides, an interior portion, a smooth outer face adapted to receive a graphical image, a single-faced corrugated inner face and a first and second attachment points each located at a respective side and each point complementary located with respect to the first panel attachment points;

each said panel comprising a flexible, fibrous, thermally-insulative material;

a first and second connection joint comprised of a stretchable, flexible, adhesive material connecting the first insulative panel to the second insulative panel, said first connection joint connecting said first panel attachment point on said first insulative panel to said first panel attachment point on said second insulative panel and said second connection joint connecting said second panel attachment point on said first insulative panel to said second panel attachment point on said second insulative panel;

said device having a collapsed coaster configuration with said first and second panels positioned in juxtaposed, overlying relation and an overall thickness which is generally the sum of the thicknesses of said first and second panels;

said device having a generally elliptical cross-sectional holder configuration defining a receiver adapted to receive and frictionally secure different sized beverage containers or vessels therebetween said device having a memory characteristic which enables the device to spring back to the collapsed coaster configuration when empty; and said panels presenting first and second projected dihedral angles at said first and second joints respectively, each said dihedral angle being adjustable through a range of approximately 0° to approximately 180°.

* * * * *